United States Patent [19]

Kondo et al.

[11] Patent Number: 4,580,153

[45] Date of Patent: Apr. 1, 1986

[54] RECORD MATERIAL

[75] Inventors: Mitsuru Kondo, Hyogo; Nobuo Kanda, Hirakata; Akio Noguchi, Takatsuki; Yukio Takayama, Toyonaka, all of Japan

[73] Assignee: Kanzaki Paper Manufacturing Co., Ltd., Tokyo, Japan

[21] Appl. No.: 633,980

[22] Filed: Jul. 24, 1984

[30] Foreign Application Priority Data

Jul. 26, 1983 [JP] Japan ..... 58-137126

[51] Int. Cl.[4] ..... B41M 5/16; B41M 5/18; B41M 5/22

[52] U.S. Cl. ..... 346/220; 346/218; 346/221; 346/223; 346/224; 427/151

[58] Field of Search ..... 346/220, 221, 218, 224, 346/204, 223; 427/150, 151, 152

[56] References Cited

U.S. PATENT DOCUMENTS 4,020,056 5/1977 Farber ..... 346/221
4,107,428 8/1978 Farber ..... 346/221

FOREIGN PATENT DOCUMENTS 301885 8/1982 European Pat. Off. ..... 346/221

*Primary Examiner*—Bruce H. Hess
*Attorney, Agent, or Firm*—Fisher, Christen & Sabol

[57] ABSTRACT

A record material utilizing the color forming reaction between a substantially colorless chromogenic material and an electron accepting reactant material is disclosed. The colorless chromogenic material used comprises a mixture of the first component consisting of at least one specified phthalide compound having two vinyl linkages and the second component of another kind of chromogenic material which is different from said first component. The first component of the chromogenic material is used in an amount of 5 to 80%, preferably 7 to 50%, by weight with respect to the amount of the second component and in such an amount that the reflectance at any wavelength within the range of 580 nm to 880 nm, preferably within the range of 500 to 880 nm of color images developed by said color forming reaction is less by at least 55% than that of said record material before color developing.

12 Claims, No Drawings

RECORD MATERIAL

BACKGROUND OF THE INVENTION

1. Field of the Invention

This invention relates to a record material adapted for use in reading by an optical character- or mark-reading machine.

There are known various kinds of recording systems utilizing the colorforming reaction between a colorless or substantially colorless chromogenic material and an electron accepting acidic reactant material by the medium of mechanical, heat, electric or light energy. Among them there are included a pressure sensitive record sheet, a heat sensitive record sheet, an electrothermal record sheet, an ultrasonic record sheet, an electron beam record sheet, an electrostatic record sheet and a photosensitive record sheet. The colorless chromogenic materials of these kinds also find their usefulness in photosensitive printing material, typewriter ribbons, ball-point pen ink, crayon and stamp ink.

On the other hand, various optical character- or mark-reading machines are used for reading the record images developed on a record material. Record images developed on the conventional record materials such as those of black, blue, red and green can be read by optical reading machines which are capable of reading for the visible wavelength range of 400 nm to 700 nm, but those record images cannot be detected by optical reading machines which are capable of reading for the infrared wavelength range of 700 nm to 900 nm because those images function not as read colors but as dropout colors.

Many of record materials which are processed for reading by optical reading machines are used as various business forms on which ruled lines, column frames, item indications, and other letters for explanation, etc. are usually pre-printed. Those pre-printed markings must be printed by ink of a dropout color so that erroneous reading by an optical reading machine may not be caused. In case where an optical reading machine having a visible wavelength reading range is used, an extremely careful consideration for selecting the kind and amount of the ink used is required to ensure a good readability. In order to avoid careful consideration for selecting the ink used, there has been proposed the utilization of various optical reading machines having infrared wavelength reading ranges.

Recently it has been proposed to utilize phthalide compounds having two vinyl linkages as substantially colorless chromogenic material which are adapted for optical reading with near infrared rays.

However, if any of those compounds is solely used as a colorless chromogenic material for a record material, though the color images developed upon contact with an electron accepting reacting material are remarkably absorptive of near infrared rays, the chromogenic material is relatively or appreciably absorptive of near infrared rays even before color developing. Accordingly, when such compounds like those are used e.g. for heat sensitive record material erroneous reading often occurs with use of an optical reading machine having a near infrared wavelength reading range since there is only poor contrast between color images developed and the background thereof. On the other hand, the color images obtained with use of such phthalide compounds having two vinyl linkages are substantially illegible with use of an optical reading machine having a visible wavelength reading range since those color images shows poor absorption of visible rays in addition to the fact that those color images are only visible in a faint blue green color and accordingly reduce the commercial value of the record material.

It is the principal object of the invention to provide a record material which can develop record images in such a visible color as black, blue, red or green and is also adapted to optical reading machines having wide reading ranges over visible and infrared wavelengths.

2. Description of the Prior Art

U.S. Pat. No. 4,020,056 issued Apr. 26, 1977 and U.S. Pat. No. 4,107,428 issued Aug. 15, 1978 discloses certain kinds of phthalide derivative chromogenic compounds having two vinyl linkages which compounds may be converted to colored forms upon reactive contact with acidic material. The color images developed have near infrared color response. EP Application No. 82301885.8 (EP Publication No. 62544) discloses another phthalide compounds in which the color images when developed therefrom have a good light resistance and show a good absorption for infrared rays.

SUMMARY OF THE INVENTION

The record material according to the invention utilizes the color forming reaction between a substantially colorless chromogenic material and an electron accepting reactant material. The substantially colorless chromogenic material used according to the invention comprises a mixture of the first component consisting of at least one phthalide compound having two vinyl linkages and the second component of another kind of chromogenic material which is different from said first component. The first component of the chromogenic material is used in an amount of 5 to 80%, preferably 7 to 50%, by weight with respect to the amount of the second component and in such an amount that the reflectance at any wavelength within the range of 580 nm to 880 nm, preferably within the range of 500 to 880 nm of color images developed by said color forming reaction is less by at least 55% than that of said record material before color developing.

The phthalide compound for the first component is represented by the following formula [I].

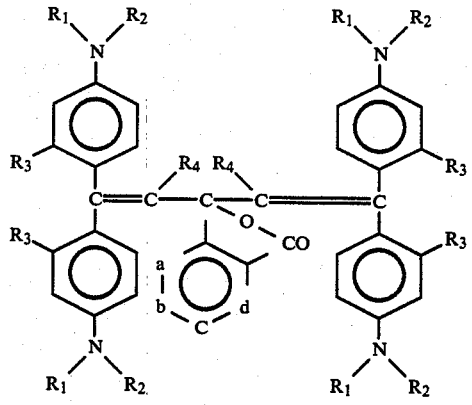

(I)

wherein each $R_1$, $R_2$ is alkyl which may be substituted by halogen, alkoxyl or acetyl, alicyclic, aryl which may be substituted by halogen, alkyl or alkoxyl, aralkyl which may be substituted by halogen, alkyl or alkoxyl, or one or each or both of $R_1$ and $R_2$ together with the adjacent nitrogen may form a heterocyclic ring; $R_3$ is hydrogen, halogen, alkyl, alkoxyl or acyloxy; $R_4$ is hydrogen or alkyl; and each a, b, c, d is carbon or nitrogen atom, but at least two of them are carbon atoms which may be substituted by hydrogen, halogen, alkyl, alkoxyl, dialkylamino or nitro, and a—b, b—c or c—d bond may form a part of another aromatic ring.

If the amount of the first component comprising at least one specified phthalide compound is less than 5% by weight of the amount of the second component of the chromogenic material, the color images developed therefrom are substantially illegible by an optical reading machine having an infrared wavelength reading range. On the contrary, if the amount of the first component comprising at least one specified phthalide compound is larger than 80% by weight of the amount of the second component of the chromogenic material, the reflectance of the record material utilizing such chromogenic material, e.g., when used as heat-sensitive record material, is relatively small at the infrared wavelength reading range even before color developing. Accordingly, the record material causes erroneous reading with use of an optical reading apparatus having an infrared wavelength reading range.

In addition to the above, according to the invention, the following condition must be satisfied with respect to any wavelength within the range of 580 nm to 880 nm between the reflectance A of the record material before color developing and the reflectance B of color images developed by the color forming reaction.

$$A\% - B\% \geqq 55\%$$

Accordingly, the initial reflectance A of the record material before color developing must be at least 55% within the specified wavelength range.

The proper amount of the first component of the substantially colorless chromogenic material consisting at least one phthalide compound of the specified kind applied on the record material would be within the range of 0.02 to 0.8 g/m$^2$, more preferably within the range of 0.04 to 0.6 g/m$^2$.

DETAILED DESCRIPTION OF THE INVENTION

Among the first component of the chromogenic materials, which is the phthalide compound represented by the above formula (I). There are included 3,3-bis(1,1-bis(4-dimethylaminophenyl)ethylene-2-yl)-4,5,6,7-tetrachlorophthalide, 3,3-bis(1,1-bis(4-diethylaminophenyl-)ethylene-2-yl)-4,5,6,7-tetrachlorophthalide, 3,3-bis(1,1-bis(4-dipropylaminophenyl)-ethylene-2-yl)-4,5-6,7-tetrachlorophthalide, 3,3-bis(1,1-bis(4-dibutylaminophenyl)ethylene-2-yl)-4,5,6,7-tetrachlorophthalide, 3,3-bis(1,1-bis(4-bischloroethylaminophenyl)ethylene-2-yl)-4,5,6,7-tetrachlorophthalide, 3,3-bis(1,1-bis(4-bisethoxyethyl-aminophenyl)ethylene-2-yl)4,5,6,7-tetrachlorophthalide, 3,3-bis(1,1-bis(4-N-methyl-N-cyclohexylaminophenyl)ethylene-2-yl)-4,5,6,7-tetrachlorophthalide, 3,3-bis(1,1-bis(4-N-methyl-N-phenylaminophenyl)ethylene-2-yl)-4,5,6,7-tetrachlorophthalide, 3,3-bis(1,1-bis(2-methyl-4-diethylaminophenyl)ethylene-2-yl)-4,5,6,7-tetrachlorophthalide, 3,3-bis(1,1-bis(2-methoxy-4-diethylaminophenyl)ethylene-2-yl)-4,5,6,7-tetrachlorophthalide, 3,3-bis(1,1-bis(4-dimethylaminophenyl-1-propene-2-yl)-4,5,6,7-tetrachlorophthalide, 3,3-bis(1,1-bis(4-dimethylaminophenyl)-ethylene-2-yl)-5-pyrrolidinophthalide, 3,3-bis(1,1-bis(4-dimethylaminophenyl)ethylene-2-yl)-6-pyrrolidinophthalide, 3,3-bis(1,1-bis(4-dimethylaminophenyl)ethylene-2-yl)-5,6,-dichlorophthalide, 3,3-bis(1,1-bis(4-dimethylaminophenyl)-ethylene-2-yl)phthalide, 3,3-bis(1,1-bis(4-dimethylaminophenyl)-ethylene-2-yl)-5-dimethylaminophthalide, 3,3-bis(1,1-bis(4-dimethylaminophenyl)ethylene-2-yl)-6-dimethylaminophthalide, 3,3-bis(1,1-bis(4-dimethylaminophenyl)ethylene-2-yl)-5-nitrophthalide, 3,3-bis(1,1-bis(4-dimethylaminophenyl)ethylene-2-yl)-6-nitrophthalide, 3,3-bis(1,1-bis(4-diethylaminophenyl)ethylene-2-yl)-5-ethoxyphthalide, 3,3-bis(1,1-bis(4-diethylaminophenyl)-ethylene-2-yl)-6-ethyoxyphthalide, 3,3-bis(1,1-bis(4-dimethylaminophenyl)-ethylene-2-yl)-5-methylphthalide, 3,3-bis(1,1-bis(4-dimethylaminophenyl)ethylene-2-yl)-6-methylphthalide, 3,3-bis(1,1-bis-(4-N-ethyl-N-benzylaminophenyl)ethylene-2-yl)-4,5,6,7-tetrachlorophthalide, 3,3-bis(1,1-bis-(4-N-methyl-N-p-tolylaminophenyl)ethylene-2-yl)-4,5,6,7-tetrachlorophthalide, 3,3-bis(1,1-bis(4-dimethylaminophenyl)ethylene-2-yl)-5,6-benzophthalide, 3,3-bis(1,1-bis(4-dimethylaminophenyl)ethylene-2-yl)-4-azaphthalide, 3,3-bis(1,1-bis(4-dimethylaminophenyl)-ethylene-2-yl)-5-azaphthalide, 3,3-bis(1,1-bis(4-dimethylaminophenyl)ethylene-2-yl)-6-azaphthalide, 3,3-bis(1,1-bis(4-dimethylaminophenyl)ethylene-2-yl)-7-azaphthalide, 3,3-bis(1,1-bis(4-dimethylaminophenyl)ethylene-2-yl)-4,7-diazaphthalide, 3,3-bis(1,1-bis(4-dimethylaminophenyl)ethylene-2-yl)-5,6-benzo-4,7-diazaphthalide, 3,3-bis(1,1-bis(4-pyrrolidinophenyl)-ethylene-2-yl)-phthalide, 3,3-bis(1,1-bis(4-pyrrolidinophenyl)-ethylene-2-yl)-4,5,6,7-tetrachlorophthalide, 3,3-bis(1,1-bis(4-pyrrolidinophenyl)-ethylene-2-yl)-5-nitrophthalide, 3,3-bis(1,1-bis(4-pyrrolidinophenyl)ethylene-2-yl)-6-nitrophthalide, 3,3-bis(1,1-bis(4-pyrrolidinophenyl-)ethylene-2-yl)-5-ethoxyphthalide, 3,3-bis(1,1-bis(4-pyrrolidinophenyl)ethylene-2-yl)-6-ethoxyphthalide, 3,3-bis(1,1-bis(4-pyrrolidinophenyl)ethylene-2-yl)-5-methylphthalide, 3,3-bis(1,1-bis(4-pyrrolidinophenyl)-ethylene-2-yl)-6-methylphthalide, 3,3-bis(1,1-bis(4-pyrrolidinophenyl)ethylene-2-yl)-5-pyrrolidinophthalide, 3,3-bis(1,1-bis(4-pyrrolidinophenyl)ethylene-2-yl)-6-pyrrolidinophthalide, 3,3-bis(1,1-bis(4-pyrrolidinophenyl)ethylene-2-yl)-5,6-dichlorophthalide, 3,3-bis(1,1-bis(4-piperidinophenyl)ethylene-2-yl)phthalide, 3,3-bis(1,1-bis(4-piperidinophenyl)ethylene-2-yl)-5-dimethylaminophthalide, 3,3-bis(1,1-bis(4-piperidinophenyl)ethylene-2-yl)-6-dimethylaminophthalide, 3,3-bis(1,1-bis(4-piperidinophenyl)ethylene-2-yl)-4,5,6,7-tetrachlorophthalide, 3,3-bis(1,1-bis(4-morpholinophenyl)ethylene-2-yl)-4,5,6,7-tetrachlorophthalide, 3,3-bis(1,1-bis(4-hexamethyleneiminophenyl)ethylene-2-yl)-4,5,6,7-tetrachlorophthalide, 3,3-bis(1,1-bis(2-methyl-4-pyrrolidinophenyl)-ethylene-2-yl)-4,5,6,7-tetrachlorophthalide, 3,3-bis(1,1-bis(2-methoxy-4-pyrrolidinophenyl)ethylene-2-yl)-4,5,6,7-tetrachlorophthalide, 3,3-bis(1,1-bis(2-acetoxy-4-pyrrolidinophenyl)-ethylene-2-yl)-4,5,6,7-tetrachlorophthalide, 3,3-bis(1,1-bis(4-pyrrolidinophenyl)-1-propene-2-yl)-4,5,6,7-tetrachlorophthalide, 3,3-bis(1,1-bis(1-methyl-1,2,3,4-tetrahydroquinoline-4-yl)-ethylene-2-yl)-4,5,6,7-tetrachlorophthalide, 3,3-bis(1,1-bis(julolidine-5-yl)ethylene-2-yl)-4,5,6,7-tetrachlorophthalide, 3,3-bis(1,1-bis(4-N-methyl-N-chloroethylaminophenyl)-ethylene-2-yl)-4,5,6,7-tetrachlorophthalide, 3,3-bis(1,1-bis(4-N-ethyl-N-chloroethylaminophenyl)ethylene-2-yl)-4,5,6,7-tetrachlorophthalide, 3,3-bis(1,1-bis(4-N-methyl-N-methoxyethylaminophenyl)ethylene-2-yl)-4,5,6,7-tetrachlorophthalide, 3,3-bis(1,1-bis(4-N-ethyl-N-ethoxyethylaminophenyl)ethylene-2-yl)-4,5,6,7-tetrachlorophthalide, 3,3-bis(1,1-bis(4-N-methyl-N-2,3-dimethoxypropylaminophenyl)ethylene-2-yl)-4,5,6,7-tetrachlorophthalide, 3,3-bis(1,1-bis(4-N-ethyl-N-2,3-dimethoxypropylaminophenyl)ethylene-2-yl)-4,5,6,7-tetrachlorophthalide and the like.

Among the first component as described above, there are preferably used the phthalide compounds represented by the following formula (V):

[V]

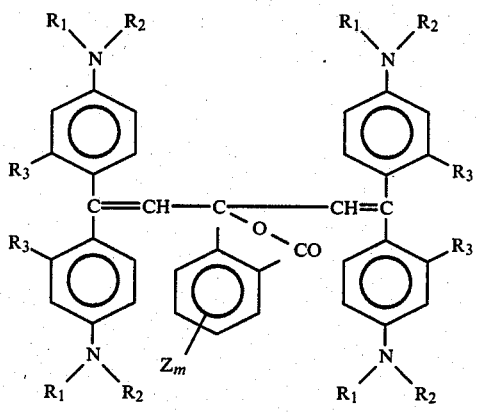

wherein $R_1$, $R_2$ and $R_3$ are the same as described above, Z is hydrogen or halogen and m is an integer of 1 to 4.

Particularly, the phthalide compounds represented by the above formula (V) in which each $R_1$, $R_2$ is alkyl having 1 to 4 carbon atoms which may be substituted by chlorine, acetyl, or alkoxyl having 1 or 2 carbon atoms, cyclohexyl, phenyl which may be substituted by alkyl having 1 or 2 carbon atoms, alkoxyl having 1 or 2 carbon atoms or chlorine, or benzyl which may be substituted by alkyl having 1 or 2 carbon atoms, alkoxyl having 1 or 2 carbon atoms or chlorine, or both of $R_1$ and $R_2$ together with the adjacent nitrogen atom may form pyrrolidine, piperidine, morpholine or hexamethyleneimine ring; $R_3$ is hydrogen, alkyl having 1 or 2 carbon atoms, alkoxyl having 1 or 2 carbon atoms or acyloxy having 1 or 2 carbon atoms; and Z is hydrogen or chloride are most preferably used.

Among the second component of the chromogenic materials, which is used together with the above specific phthalide compounds according to the invention, there are included diphenylmethane compounds such as 4,4'-bis-dimethylaminobenzhydryl benzyl ether, 4,4'-bis-dimethylaminobenzhydryl-p-toluenesulfinate, N-chlorophenylleucoauramine, N,N'-bis(bis-(4-dimethylaminophenyl)methyl)-1,6-hexamethylenediamine, 4,4'-bis(4,4'-tetramethyldiaminodiphenylamino)diphenylmethane, 4,4'-(bis(dimethylaminobenzhydryl)) ether; spiropyran compounds such as 1',3'-dihydro-1',3',3'-trimethyl-spiro(2H-1-benzopyran-2,2'-(2H)-indol),1',3'-dihydro-1',3',3'-trimethyl-7-diethylamino-spiro(2H-1-benzopyran-2,2'-(2H)-indole), 2-ethoxy-spiro(4H-1-benzothiopyran-4,3'-(3H)naphtho-(2,1-b)pyran), 2-methyl-4-4-ethylthio-1,2-dihydrophthalazino-1,2'-spiro-6'-nitro-2H-1-benzopyran and the spiropyran compounds which can develop a blue color upon contact with an electron accepting material and which have the following formula [IV],

[IV]

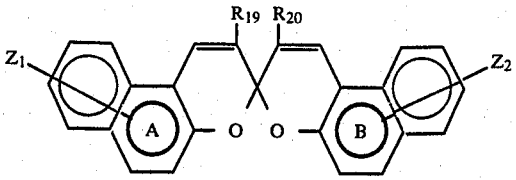

wherein each $R_{19}$, $R_{20}$ is hydrogen, alkyl which may be substituted by halogen or alkoxyl, aralkyl which may be substituted by alkyl, halogen or alkoxyl, phenyl which may be substituted by alkyl, halogen or alkoxyl, or $R_{19}$ together with $R_{20}$ may form alkylene; each $Z_1$, $Z_2$ is hydrogen, halogen, alkyl, alkoxyl or

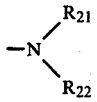

(each $R_{21}$, $R_{22}$ is alkyl which may be substituted by halogen or alkoxyl, unsaturated alkyl, alicyclic, aryl which may be substituted by halogen, alkyl or alkoxyl, aralkyl which may be substituted by halogen, alkyl or alkoxyl, or both of $R_{21}$ and $R_{22}$ together with the adjacent nitrogen may form a heterocyclic ring); and each A, B is benzene or naphthalene ring; triarylmethanelactone compounds such as 3,3-bis(1-ethyl-2-methylindole-3-yl)phthalide, 3,3-bis(1-octyl-2-methylindole-3-yl)phthalide, 3,3-bis(1-ethyl-2-methylindole-3-yl)-7-azaphthalide, 3-(4-diethylamino-2-hydroxy)phenyl-3-(2-methoxy-4-methyl-5-anilino)phenylphthalide, 3-(4-pyrrolidino-2-hydroxy)-phenyl-3-(2-methoxy-4-methyl-5-anilino)phenylphthalide, 3-(4-N-methyl-N-cyclohexylamino-2-hydroxy)phenyl-3-(2-methoxy-4-methyl-5-anilino)phenylphthalide, 3-(4-N-ethyl-N-i-pentylamino-2-hydroxy)phenyl-3-(2-methoxy-4-methyl-5-anilino)-phenylphthalide, 3-(N-ethyl-N-p-tolylamino-2-hydroxy)phenyl-3-(2-methoxy-4-methyl-5-anilino)phenylphthalide, 3-(4-diethylamino-2-hydroxy)phenyl-3-(2-methoxy-4-chloro-5-anilino)-phenylphthalide, 3-(4-diethylamino-2-hydroxy)phenyl-3-(2-methoxy-4-chloro-5-ethoxyethylamino)-phenylphthalide, 3-(4-diethylamino-2-hydroxy)phenyl-3-(2-methoxy-5-m-trifluoromethylanilino)phenylphthalide, 3-(4-dibutylamino-2-hydroxy)-phenyl-3-(2-methoxy-5-o-chloroanilino)-phenylphthalide and the triarylmethanelactone compounds which can develop a blue color upon contact with an electron accepting material and which have the following formula [III],

[III]

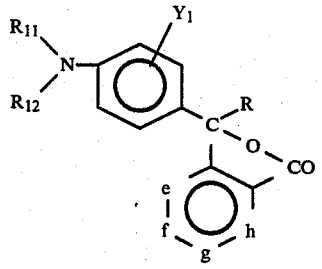

wherein each $R_{11}$, $R_{12}$ is alkyl which may be substituted by halogen or alkoxyl, unsaturated alkyl, alicyclic, aryl which may be substituted by halogen, alkyl or alkoxyl, aralkyl which may be substituted by halogen, alkyl or alkoxyl, or both of $R_{11}$ and $R_{12}$ together with the adjacent nitrogen may form a heterocyclic ring; $Y_1$ is hydrogen, alkyl, alkoxyl or halogen; R is

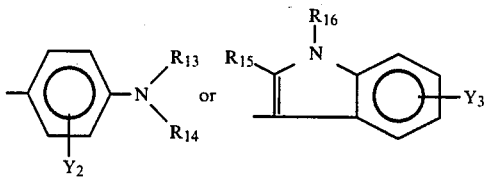

(each $R_{13}$, $R_{14}$ is the same as described above as $R_{11}$ and $R_{12}$, each $Y_2$, $Y_3$ is the same as described above as $Y_1$ and $R_{15}$ is alkyl or phenyl and $R_{16}$ is hydrogen or alkyl); each e, f, g, h is carbon or nitrogen atom but at least two of them are carbon atoms which may be substituted by hydrogen, alkyl, alkoxyl, halogen or

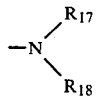

(each $R_{17}$, $R_{18}$ is the same as described above as $R_{11}$ and $R_{12}$) and e-f, f-g or g-h bond of which may form a part of another aromatic ring; fluoran compounds such as 3-diethylamino-6-methylfluoran, 3-diethylamino-7-methylfluoran, 3-diethylamino-7-chrolofluoran, 3-diethylamino-6,8-dimethylfluoran, 3-diethylamino-7-phenylfluoran, 3-diethylamino-5-mehtyl-7-t-butylfluoran, 3-diethylamino-6-methyl-7-chlorofluoran, 3-diethylamino-7-methoxyfluoran, 3-cyclohexylamino-7-methylfluoran, 3-cyclohexylamino-6-chlorofluoran, 3-benzylamino-6-chlorofluoran, 3-diethylamino-7-chlorofluoran, 3-diethylamino-7,8-benzofluoran, 3-diethylamino-6-methoxyfluoran, 3-diethylamino-7-(N-methyl-N-acetyl)aminofluoran, 4-benzylamino-8-diethylamino-benzo(a)fluoran, 3-anilino-8-diethylamino-benzo(a)fluoran, 3,6-bis(diethylamino)fluoran-r-anilinolactam, 3,6-bis(diethylamino)fluoran-r-o-chloroanilinolactam, and the fluoran compounds which can develop a black color upon contact with an electron accepting material and which have the following formula [II],

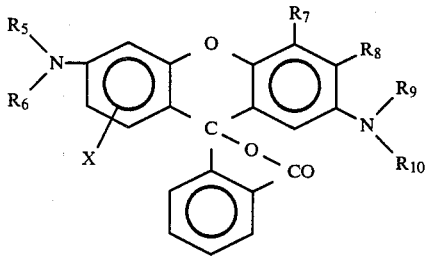

[II]

wherein each $R_5$, $R_6$ is alkyl which may be substituted by halogen or alkoxyl, unsaturated alkyl, alicyclic, aryl which may be substituted by halogen, alkyl or alkoxyl, aralkyl which may be substituted by halogen, alkyl or alkoxyl, or both of $R_5$ and $R_6$ together with the adjacent nitrogen may form a heterocyclic ring; each $R_7$, $R_8$ is hydrogen, alkyl, halogen or alkoxyl; each $R_9$, $R_{10}$ is hydrogen, alkyl which may be substituted by halogen, alkoxyl, alkoxycarbonyl or dialkylamino, alicyclic, aryl which may be substituted by halogen, alkyl, alkoxyl, halogenated alkyl, alkoxycarbonyl or dialkylamino, or aralkyl which may be substituted by halogen, alkyl, alkoxyl halogenated alkyl, alkoxycarbonyl or dialkylamino; and X is hydrogen, alkyl or halogen; lucoazine compounds such as 3,7-bis(dimethylamino)-10-benzoylphenothiazine, and 3-diethyl-7-(N-methylanilino)-10-benzoylphenoxazine.

The above mentioned chromogenic materials for the second component may be used either solely or in combination.

The fluoran compounds having the above formula (II) are the chromogenic materials which can develop a very dark color such as black, greenish black, bluish black, reddish black, black brown or the like upon contact with an electron accepting material when they are used solely. Among the fluoran compounds, there are included 3-diethylamino-6-methyl-7-anilinofluoran, 3-diethylamino-6-methyl-7-toluidinofluoran, 3-diethylamino-6-methyl-7-xylidinofluoran, 3-diethylamino-6-methyl-7-mesitidinofluoran, 3-diethylamino-6-methyl-7-(p-butylanilino)fluoran, 3-diethylamino-6-methyl-7-anisidinofluoran, 3-diethylamino-6-methyl-7-p-phenetidinofluoran, 3-dimethylamino-6-methyl-7-anilinofluoran, 3-dipropylamino-6-methyl-7-anilinofluoran, 3-di(β-ethoxyethyl)-amino-6-methyl-7-anilinofluoran, 3-di(chloroethyl)amino-6-methyl-7-anilinofluoran, 3-dibenzylamino-6-methyl-7-anilinofluoran, 3-N-methyl-cyclohexylamino-6-methyl-7-anilinofluoran, 3-N-allyl-N-n-pentylamino-6-methyl-7-anilinofluoran, 3-pyrrolidino-6-methyl-7-anilinofluoran, 3-piperidino-6-methyl-7-anilinofluoran, 3-piperidino-6-methyl-7-toluidinofluoran, 3-piperidino-6-methyl-7-(p-butylanilino)fluoran, 3-methylpiperidino-6-methyl-7-(p-butylanilino)fluoran, 3-morpholino-6-methyl-7-(p-butylanilino)fluoran, 3-(N-methyl-anilino)-6-methyl-7-anilinofluoran, 3-(N-ethyl-anilino)-6-methyl-7-anilinofluoran, 3-(N-benzyl-anilino)-6-methyl-7-anilinofluoran, 3-(N-ethyl-p-toluidino)-6-methyl-7-anilinofluoran, 3-(N-ethyl-p-chloroanilino)-6-methyl-7-anilinofluoran, 3-(N-ethyl-anilino)-6-methyl-7-(p-toluidino)fluoran, 3-(N-ethyl-p-toluidino)-6-methyl-7-(p-toluidino)fluoran, 3-N-benzyl-xylidino-6-methyl-7-(p-toluidino)fluoran, 3-(N-chloroethyl-p-toluidino)-6-methyl-7-xylidinofluoran, 3-N-ethyl-anilino-6-methyl-7-(p-butylanilino)fluoran, 3-dibutyl-amino-6-methyl-7-anilinofluoran, 3-(N-methyl-N-propylamino)-6-methyl-7-anilinofluoran, 3-(N-ethyl-N-i-pentylamino)-6-methyl-7-anilinofluoran, 3-(N-ethyl-N-n-hexylamino)-6-methyl-7-anilinofluoran, 3-hexamethyleneimino-6-methyl-7-anilinofluoran, 3-(2,3-dihydro-isoindole-2-yl)-6-methyl-7-anilinofluoran, 3-diethylamino-6-chloro-7-anilinofluoran, 3-diethylamino-6-bromo-7-anilinofluoran, 3-diethylamino-6-iodo-7-anilinofluoran, 3-diethylamino-6-chloro-7-ethoxyethylaminofluoran, 3-diethylamino-6-chloro-7-chloropropylaminofluoran, 3-diethylamino-6-chloro-7-cyclohexylaminofluoran, 3-diethylamino-1,6-dimethyl-7-anilinofluoran, 3-diethylamino-4-chloro-6-methyl-7-anilinofluoran, 3-diethylamino-7-(o-chloroanilino)-fluoran, 3-dibutylamino-7-(o-chloroanilino)fluoran, 3-diethylamino-7-(o-bromoanilino)fluoran, 3-dibutylamino-7-(o-fluoroanilino)fluoran, 3-diethylamino-7-(o-methoxycarbonylphenyl-amino)fluoran, 3-diethylamino-7-(o-(i-pentyloxy)carbonylphenylamino)fluoran, 3-diethylamino-7-diphenylaminofluoran, 3-diethylamino-7-bis(α-phenylethyl)-aminofluoran, 3-diethylamino-5,6-dimethyl-7-anilinofluoran, 3-diethylamino-5-chloro-6-methyl-7-anilinofluoran, 3-dibutylamino-6-methyl-7-(p-chloroanilino)fluoran, 3-diethylamino-7-(m-trifluoromethylanilino)fluoran, 3-dibutylamino-7-(p-trifluoromethylanilino)-fluoran, 3-diethylamino-7-(N-methyl-trifluoromethylanilino)-fluoran, 3-dimethylamino-7-trifluoromethylanilinofluoran, 3-dimethylamino-7-(N-methyl-trifluoromethylanilino)fluoran, 3-dimethylamino-7-(N-ethyl-trifluoromethylamino)-fluoran, 3-dimethylamino-7-(N-benzyl-trifluoromethylanilino)fluoran, 3-diethylamino-5-methyl-7-trifluoromethylanilinofluoran, 3-diethylamino-5-ethyl-7-trifluoromethylanilinofluoran, 3-diethylamino-5-chloro-7-trifluoromethylanilinofluoran, 3-diethylamino-5-methyl-7-(N-methyl-trifluoromethylanilino)-fluoran.

Among the fluoran compounds as described above, there are preferably used the fluoran compounds represented by the following formula (VI);

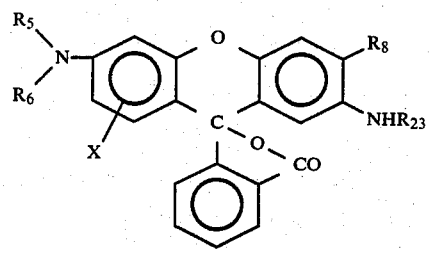

[VI]

wherein $R_5$, $R_6$, $R_8$ and X are the same as described above and $R_{23}$ is the same as described above as $R_9$ and $R_{10}$, because the record material comprising the fluoran compounds as the second component can develop a color which absorbs light of substantially whole visual and infrared regions whereby optical reading machines having a reading wavelength within visual and infrared regions can be widely applied to read the developed images.

Particularly, among the fluoran compounds represented by the above formula (VI) there are most preferably used the fluoran compounds represented by the following formulae (VII), (VIII) or (IX);

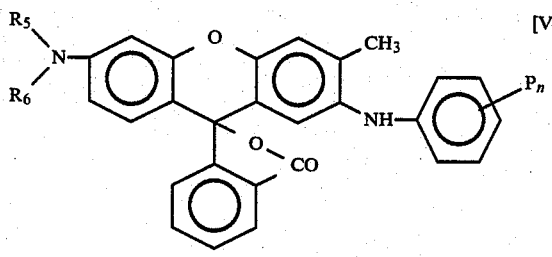

[VII]

wherein $R_5$ and $R_6$ are the same as described above, P is hydrogen, alkyl, alkoxyl, halogen, dialkylamino or halogenated alkyl, and n is an integer of 1 to 4.

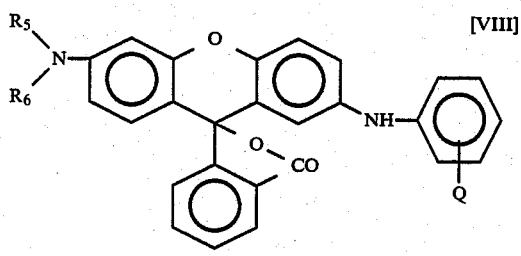

[VIII]

wherein $R_5$ and $R_6$ are the same as described above, and Q is halogen, halogenated alkyl or alkoxycarbonyl,

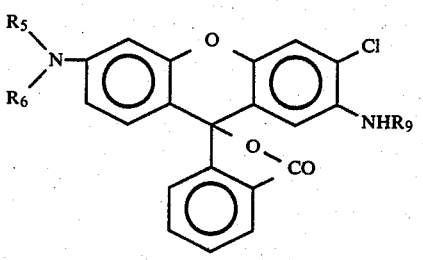

[IX]

wherein $R_5$, $R_6$ and $R_9$ are the same as described above.

Further, the spiropyran compounds having the above formula (IV) are the chromogenic materials which can develop a navy blue or black blue color upon contact with an electron accepting material when they are used solely. Among the spiropyran compounds, there are included 2,2'-spiro-di(2H-1-benzopyran), 2,2'-spiro-di((2H)-naphtho-(2,1-b)-pyran), 3'-methyl-2,2'-spiro-di((2H)-naphtho-(2,1-b)pyran), 3-benzyl-2,2'-spiro-di((2H)-naphtho-(2,1-b)-pyran), 3-octyl-2,2'-spiro-di((2H)-naphtho-(2,1-b)pyran), 3,3'-trimethylene-2,2'-spiro-di((2H)-naphtho-(2,1-b)-pyran), spiro-(2H-1-benzopyran)-2,2'-((2H)-naphtho-(2,1-b)-pyran), 10-chlorospiro(2H-1-benzopyran)-2,2'-((2H)-naphtho-(2,1-b)pyran), 3'-phenyl-7-dimethylamino-2,2'-spiro-di(2H-1-benzopyran), 3'-phenyl-7-diethylamino-2,2'-spiro-di(2H-1-benzopyran), 3'-phenyl-7-diethylamino-spiro-(2H-1-benzopyran)-2,2'-((2H)-naphtho-(2,1-b)-pyran), 3'-phenyl-6'-chloro-7-diethylamino-2,2'-spiro-di-(2H-1-benzopyran), 3-phenyl-3'-ethyl-7-diethylamino-2,2'-spiro-di-(2H-1-benzopyran), 3,3'-diphenyl-7-diethylamino-2,2'-spiro-di-(2H-1-benzopyran), 3'-(p-tolyl)-7-diethylamino-2,2'-spiro-di-(2H-1-benzopyran), 3-phenyl-7,7'-bis-diethylamino-2,2'-spiro-di-(2H-1-benzopyran), 3'-phenyl-7-dibenzylamino-7'-dimethylamino-2,2'-spiro-di(2H-1-benzopyran, 3'-isopropyl-7,7'-bis-dimethylamino-spiro-di-(2H-1-benzopyran), 3,3'-trimethylene-7,7'-bis-dimethylamino-2,2'-spiro-di-(2H-1-benzopyran), 3,3'-(β-t-butyltrimethylene)-7,7'-diethylamino-2,2'-spiro-di-(2H-1-benzopyran), 3'-methyl-7-(N-methyl-N-p-tolyl)amino-2,2'-spiro-di-(2H-1-benzopyran), 3'-benzylamino-7-(N-methyl-N-p-chloroanilino)-2,2'-spiro-di-(2H-1-benzopyran), 3'-methyl-7-di-phenethylamino-spiro-(2H-1-benzopyran)-2,2'-(2H)-naphtho-(2,1-b)-pyran, 3'-methyl-7-pyrrolidino-2,2'-spiro-di-(2H-1-benzopyran), 3'-methyl-7-morpholino-2,2'-spiro-di-(2H-1-benzopyran), 3'-phenyl-8'-methoxy-7-diethylamino-2,2'-spiro-di-(2H-1-benzopyran).

Particularly, among the above spiropyran compounds, there are preferably used the compounds represented by the following formula (X);

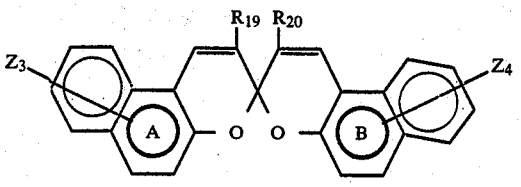

[X]

wherein $R_{19}$, $R_{20}$, A and B are the same as described above, and each $Z_3$, $Z_4$ is hydrogen or

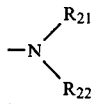

($R_{21}$ and $R_{22}$ are the same as described above).

The triarylmethane compounds having the above formula (III) are the chromogenic materials which can develop a blue, bluish violet or black blue color upon contact with an electron accepting material when they are used solely. Among the triarylmethane compounds, there are included 3,3-bis(4-dimethylaminophenyl)-6-dimethylaminophthalide, 3,3-bis(4-dimethylaminophenyl)-6-pyrrolidinophthalide, 3-(4-dimethylaminophenyl)-3-(4-diethylaminophenyl)-6-dimethylaminophthalide, 3-(4-dimethylaminophenyl)-3-(4-N-ethyl-N-benzylaminophenyl)-6-dimethylaminophthalide, 3-(4-dimethylaminophenyl)-3-(4-N-methyl-N-p-tolylaminophenyl)-6-dimethylaminophthalide, 3-(4-dimethylaminophenyl)-3-(4-diethylamino-2-methylphenyl)-6-dimethylaminophthalide, 3-(4-dimethylaminophenyl)-3-(4-diethylamino-2-chlorophenyl)-6-dimethylaminophthalide, 3-(4-dimethylaminophenyl)-3-(4-pyrrolidinophenyl)-6-dimethylaminophthalide, 3-(4-dimethylaminophenyl)-3-(4-morpholinophenyl)-6-dimethylaminophthalide, 3-(4-diethylamino-2-ethoxyphenyl)-3-(1-ethyl-2-methylindole-3-yl)-4-azaphthalide, 3-(4-diethylamino-2-ethoxyphenyl)-3-(1-ethyl-2-methylindole-3-yl)-7-azaphthalide.

Among the triarylmethane compounds, there are preferably used the compounds represented by the following formula (XI);

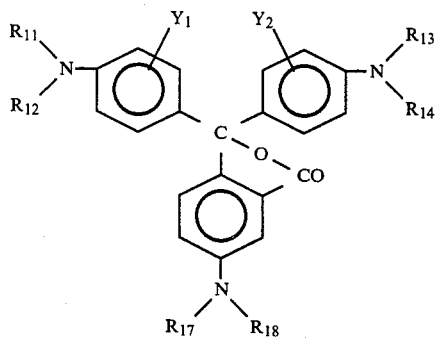

[XI]

wherein $R_{11}$, $R_{12}$, $R_{13}$, $R_{14}$, $R_{17}$, $R_{18}$, $Y_1$ and $Y_2$ are the same as described above.

The acceptors used are selected according to the kinds of record materials. The materials which are preferably used as acceptors for pressure sensitive record materials, heat sensitive record materials, electrothermal record material, ultrasonic record materials, electrostatic record materials, typewriter's ribbons, ballpoint pen ink and crayon are those which function as Bronsted or Lewis acid. Among them there are included: inorganic acceptors such as acid clay, activated clay, attapulgite, bentonite, colloidal silica, aluminum silicate, magnesium silicate, zinc silicate, tin silicate, calcined kaolin and talc; organic acceptors such as aliphatic carboxylic acids, e.g., oxalic acid, maleic acid, tartaric acid, citric acid, succinic acid and stearic acid, aromatic carboxylic acids, e.g., benzoic acid, p-tert-butylbenzoic acid, phthalic acid, gallic acid, salicylic acid, 3-isopropylsalicylic acid, 3-phenylsalicylic acid, 3-cyclohexylsalicylic acid, 3,5-di-tert-butylsalicylic acid, 3-methyl-5-benzylsalicylic acid, 3-phenyl-5-(α,α-dimethylbenzyl)salicylic acid, 3,5-di-(α-methylbenzyl)-salicylic acid and 2-hydroxy-1-benzyl-3-naphthoic acid, phenolic compounds, e.g., 4-tert-octylphenol, 4,4'-sec-butylidenediphenol, 4-phenylphenol, 4,4'-isopropylidenediphenol, 4,4'-cyclohexylidenediphenol, 4,4'-dihydroxydiphenylsulfide, 4,4'-thiobis(6-tert-butyl-3-methylphenol), 4,4'-dihydroxydiphenylsulfone, 4-hydroxybenzophenone, 2,4-dihydroxybenzophenone, 2,4,4'-trihydroxybenzophenone, 2,2',4,4'-tetrahydroxybenzophenone, dimethyl 4-hydroxyphthalate, ethyl 4-hydroxybenzoate, propyl 4-hydroxybenzoate, sec-butyl 4-hydroxybenzoate, pentyl 4-hydroxybenzoate, phenyl 4-hydroxybenzoate, benzyl 4-hydroxybenzoate, tolyl 4-hydroxybenzoate, chlorophenyl 4-hydroxybenzoate, phenylpropyl 4-hydroxybenzoate, phenethyl 4-hydroxybenzoate, p-chlorobenzyl 4-hydroxybenzoate and p-methoxybenzyl 4-hydroxybenzoate, phenol resins, e.g., p-phenyl-phenolformaldehyde resin and p-butylphenol-acetylene resin; salts of the above organic acceptors with polyvalent metals such as zinc, magnesium, aluminium, calcium, titanium, manganese, tin and nickel; and inorganic acid such as hydrogen halide, e.g., hydrogen chloride, hydrogen bromide and hydrogen iodide, boric acid, silicic acid, phosphoric acid, sulfuric acid, nitric acid, perchloric acid and halides of aluminium, zinc, nickel, tin, titanium, boron and the like.

In case of electron beam record materials or photosensitive record materials, compounds which can produce by electron beam or light radiation hydrogen halogenides, such as hydrogen chloride, hydrogen bromide and hydrogen iodide, carboxylic acids, sulfonic acids or phenols are preferably used as acceptor materials. Among those compounds, there are included organic halogen compounds, such as carbon tetrabromide, α,α,α-tribromoacetophenone, hexachloroethane, iodoform, 2-tribromomethylpyridine, trichloromethyl, sulfonylbenzene, o-quinonediazido compounds, phenol esters of carboxylic acid or sulfonic acid which can cause Fries rearrangement.

Some embodiments of the typical record materials according to the invention are described hereinbelow:

For example, various kinds of pressure sensitive record materials are disclosed in U.S. Pat. Nos. 2,505,470, 2,505,471, 2,505,489, 2,548,366, 2,712,507, 2,730,456, 2,730,457, 3,418,250, 3,924,027 and 4,010,038. The invention can be applied to each of them.

A typical method for the production of a pressure sensitive record material according to the invention is as follows:

100 parts by weight of at least one chromogenic material selected from the group consisting of triarylmethanelactone compounds, spiropyran compounds, fluoran compounds, diphenylmethane compounds, azine compounds and the like, and 5 to 80 parts by weight of at least one phthalide compound represented by the above formula (I) are dissolved in a solvent to form a solution which may include synthetic oil such as alkylated naphthalene, alkylated diphenyl, alkylated diphenylmethane and alkylated terphenyl, vegetable oil such as cotton seed oil and castor oil, animal oil and mineral oil or mixtures of the foregoing. The solution may be dispersed in a binder to form a coating composition. The solution may be enclosed in microcapsules through the utilization of the coacervation technique, the interfacial polymerization technique, the in-situ polymerization technique or any other method for making oil droplet-containing microcapsules and the microcapsules thus prepared are dispersed in a binder to form a coating composition. Any one of the coating compositions thus prepared is applied to a base sheet such as a paper sheet, plastic sheet, resin coated paper sheet, etc. to obtain a pressure sensitive record material. In case where the pressure sensitive copying system consists of a top sheet, a bottom sheet and, if necessary, at least one middle sheet, the pressure sensitive record material according to the invention is used as the top sheet and the middle sheet. The pressure sensitive record material according to the invention also be utilized in the "self contained" system in which both the colorless chromogenic material and the acceptor are dispersed on one surface of the same sheet. The preferably used amount of the chromogenic materials depends on the coated amount, the kind of record material, the method for producing capsules, the coating composition, the coating method and the like. In any case, the amount of the phthalide compounds having the above formula (I) and used together with the conventional basic chromogenic material according to the invention is within the range of 5 to 80% by weight of the basic chromogenic material, so that the pressure sensitive record material which can produce color images having a good light resistance and readable with a optical reading machine can be obtained.

Various kinds of heat sensitive record materials are disclosed in Japanese Patent Publications Nos. 3,680 of 1969, 27,880 of 1969, 14,039 of 1970, 43,830 of 1973, 69 of 1974, 70 of 1974 and 20,142 of 1977. Any of them can be applied to the invention. Most typically, heat sensitive record materials according to the invention may be produced by coating a coating composition including a binder, chromogenic materials consisting of the first component and the second component and an acceptor on a base sheet such as paper sheet, plastic film, synthetic paper sheet, woven fabric sheet or mold. The coating composition may include a suitable binder material. The amount of the acceptor in the recording layer may be within the range of 1 to 50 parts by weight, preferably within the range of 2 to 10 parts by weight, per one part by weight of the chromogenic material used. The coating composition may include inorganic metal compounds such as oxides, hydroxides and carbonates of polyvalent metals and/or inorganic pigments in an amount of 0.1 to 5 parts by weight, preferably, 0.2 to 2 parts by weight, per one part by weight of the amount of the acceptor. The recording layer may also include dispersing agents, ultraviolet ray absorbing agents, heat fusible materials, antifoaming agent, fluorescent dye, coloring dyes and other adding materials.

The chromogenic materials and the acceptor may be applied to a base sheet either in the form of a single coating composition or in the form of two separate coating compositions which may be applied one by one. Application of the chromogenic materials and acceptor to a base sheet may also be carried out by impregnation or by sizing. The amount of the coating composition may preferably be within the range of 2 to 12 g/cm$^2$ on dry basis. Further, various known techniques for producing a heat sensitive record material, such as overcoating for protecting the recording layer, under-coating for improving the adhesiveness of the recording layer and the like, may be applied to the heat sensitive record material according to the invention. Among the useful binder materials there may be included starches, celluloses, proteins, gum arabic, polyvinyl alcohol, salts of styrene-maleic anhydride copolymer, styrene-butadiene copolymer emulsions, salts of vinyl acetate-maleic anhydride copolymer and salts of polyacrylic acid.

The electrothermal record materials may be produced according to any known methods such as those disclosed in Japanese Laid-Open Patent Publications Nos. 11,344 of 1974 and 48,930 of 1975. Usually, the record material of this type according to the invention may be produced, either by coating on a base sheet such as a paper sheet a coating composition consisting of a dispersion of an electroconductive material, the chromogenic materials, an acceptor and a binder, or by coating an electroconductive material on a basic sheet to form an electroconductive layer thereon and further coating on the electroconductive layer another coating composition consisting of a dispersion of the chromogenic materials, an acceptor and a binder. In case where each of the chromogenic materials and the acceptor used is not fusible within the temperature range of 70° to 120° C., an appropriate heat fusible material may be added for controlling the heat sensitivity.

The photosensitive record materials according to the invention may be produced in a similar manner to any of those disclosed in Japanese Patent Publications Nos. 24,188 of 1963, 10,550 of 1970, 13,258 of 1970, 204 of 1974, 6,212 of 1974 and 28,449 of 1974 and Japanese Laid-Open Patent Publications Nos. 31,615 of 1972, 32,532 of 1973, 9,227 of 1974, 135,617 of 1974, 80,120 of 1975, 87,317 of 1975 and 126,228 of 1975.

The invention is also applicable to other recording systems, such as, the ultrasonic record material, e.g., as disclosed in French Patent Specification No. 2,120,922, the electron beam recording system, e.g., as disclosed in Belgian Patent No. 7,959,986, the electrostatic record material, e.g., as disclosed in Japanese Patent Publication No. 3,932 of 1974, the photosensitive printing material, e.g., as disclosed in Japanese Laid-Open Patent Publication No. 12,104 of 1973, the seal stamping material, e.g., as disclosed in Japanese Patent Publication No. 10,766 of 1972, type ribbons as disclosed in Japanese Laid-Open Patent Publication No. 3,713 of 1974, ball-point pen ink as disclosed in Japanese Laid-Open Patent Publication No. 83,924 of 1973 and crayon as disclosed in U.S. Pat. No. 3,769,045, by merely using the specific chromogenic material comprising a mixture of the first component and the second component as described above.

DETAILED DESCRIPTION OF THE PREFERRED EMBODIMENT

The following examples serve to illustrate the invention in more detail although the invention is not limited to the examples. Unless otherwise indicated, parts and % signify parts by weight and % by weight, respectively.

EXAMPLE 1

(1) Preparation of A liquid

The following composition was passed through a sand mill.

| | |
|---|---|
| 3,3-bis(1,1-bis(4-pyrrolidinophenyl)-ethylene-2-yl)-4,5,6,7-tetrachlorophthalide | 1 part |
| 3-(N—methyl-N—cyclohexyl)amino-6-methyl-7-anilinofluoran | 10 parts |
| 5% aqueous solution of methylcellulose | 5 parts |

-continued

| | |
|---|---|
| water | 40 parts |

Pulverization was continued until an average particle size of 3 microns.

(2) Preparation of B liquid

The following composition was passed through a sand mill.

| | |
|---|---|
| 4,4'-isopropylidenediphenol | 20 parts |
| 5% aqueous solution of methylcellulose | 5 parts |
| water | 55 parts |

Pulverization was continued until an average particle size of 3 microns.

(3) Preparation of C liquid

The following composition was passed through a sand mill.

| | |
|---|---|
| stearic acid amide | 20 parts |
| 5% aqueous solution of methylcellulose | 5 parts |
| water | 55 parts |

Pulverization was continued until an average particle size of 3 microns.

(4) Making a heat sensitive record material

The following composition was mixed to prepare a coating composition.

| | |
|---|---|
| A liquid | 56 parts |
| B liquid | 80 parts |
| C liquid | 80 parts |
| pigment (silicon oxide having an oil absorption of 180 ml/100 g) | 15 parts |
| 20% aqueous solution of oxidized starch | 50 parts |
| water | 10 parts |

The coating composition was coated on a base sheet of 100 g/m$^2$ in the weight of an amount of 5 g/m$^2$ on dry basis to obtain a heat sensitive record material.

The heat sensitive record material was pressed with a pressure of 4 kg/cm$^2$ for 5 seconds on a plate heated at 110° C. to develop black images. The difference in reflectance at 500–880 nm between the developed images and the record material before color-development was more than 74%.

EXAMPLE 2

Example 1 was repeated except that 5 parts of 3-dibutylamino-6-methyl-7-anilinofluoran and 5 parts of 3-(N-ethyl-N-p-tolyl)amino-6-methyl-7-anilinofluoran were used instead of 10 parts of 3-(N-methyl-N-cyclohexyl)amino-6-methyl-7-anilinofluoran to prepare a heat sensitive record material.

The heat sensitive record material was pressed with a pressure 4 kg/cm$^2$ for 5 seconds on a plate heated at 110° C. to develop black images. The difference in reflectance at 500–880 nm between the developed images and the record material before color-development was more than 76%.

EXAMPLE 3

Example 1 was repeated except that 3 parts of 3,3-bis(1,1-bis(4-dimethylaminophenyl)ethylene-2-yl)-4,5,6,7-tetrachlorophthalide was used instead of 3,3-bis(1,1-bis(4-pyrrolidinophenyl)ethylene-2-yl)-4,5,6,7-tetrachlorophthalide and 7 parts of 3-diethylamino-6-methyl-7-anilinofluoran was used instead of 3-(N-methyl-N-cyclohexylamino-6-methyl-7-anilinofluoran to prepare a heat sensitive record material.

The heat sensitive record material was pressed with a pressure of 4 kg/cm$^2$ for 5 seconds on a plate heated at 110° C. to develop black images. The difference in reflectance at 500–880 nm between the developed images and the record material before color-development was more than 70%.

EXAMPLE 4

Example 1 was repeated except that 2 parts of 3,3-bis(1,1-bis(4-dimethylaminophenyl)ethylene-2-yl)-phthalide was used instead of 3,3-bis(1,1-bis(pyrrolidinophenyl)ethylene-2-yl)-4,5,6,7-tetrachlorophthalide and 10 parts of 3'-methyl-2,2'-spiro-di((2H)-naphtho-(2,1-b)pyran) was used instead of 3-(N-methyl-N-cyclohexyl)amino-6-methyl-7-anilinofluoran to prepare a heat sensitive record material.

The heat sensitive record material was pressed with a pressure of 4 kg/cm$^2$ for 5 seconds on a plate heated at 110° C. to develop blue images. The difference in reflectance at 580–880 nm between the developed images and the record material before color-development was more than 74%.

EXAMPLE 5

Example 1 was repeated except that 3-diethylamino-7-chlorofluoran was used instead of 3-(N-methyl-N-cyclohexyl)amino-6-methyl-7-anilinofluoran to prepare a heat sensitive record material.

The heat sensitive record material was pressed with a pressure of 4 kg/cm$^2$ for 5 seconds on a plate heated at 110° C. to develop red images. The difference in reflectance at 570–880 nm between the developed images and the record material before color-development was more than 64%.

EXAMPLE 6

Example 1 was repeated except that 10 parts of 3-diethylamino-6-chloro-7-anilinofluoran was used instead of 10 parts of 3-(N-methyl-N-cyclohexyl)amino-6-methyl-7-anilinofluoran to prepare a heat sensitive record material.

The heat sensitive record material was pressed with a pressure 4 kg/cm$^2$ for 5 seconds on a plate heated at 110° C. to develop black images. The difference in reflectance at 500–880 nm between the developed images and the record material before color-development was more than 75%.

EXAMPLE 7

Example 1 was repeated except that 2 parts of 3,3-bis(1,1-bis(4-morpholinophenyl)ethylene-2-yl)-4,5,6,7-tetrachlorophthalide was used instead of 3,3-bis(1,1-bis(4-pyrrolidinophenyl)ethylene-2-yl)-4,5,6,7-tetrachlorophthalide and that 10 parts of 3-(N-ethyl-N-isopentyl)amino-6-methyl-7-anilinofluoran was used instead of 3-(N-methyl-N-cyclohexyl)amino-6-methyl-7-anilinofluoran to prepare a heat sensitive record material. The heat sensitive record material was pressed with a pressure 4 kg/cm$^2$ for 5 seconds on a plate heated at 110° C. to develop black images. The difference in reflectance at 500–880 nm between the developed images and the record material before color-development was more than 72%.

EXAMPLE 8

Example 1 was repeated except that 2 parts of 3,3-bis(1,1-bis(4-hexamithyleneiminophenyl)-ethylene-2-yl)-4,5,6,7-tetrachlorophthalide was used instead of 1 part of 3,3-bis(1,1-bis(4-pyrrolidinophenyl)-ethylene-2-yl)-4,5,6,7-tetrachlorophthalide to prepare a heat sensitive record material.

The heat sensitive record material was pressed with a pressure 4 kg/cm$^2$ for 5 seconds on a plate heated at 110° C. to develop black images. The difference in reflectance at 500–880 nm between the developed images and the record material before color-development was more than 73%.

EXAMPLE 9

Example 1 was repeated except that 3 parts of 3,3-bis(1,1-bis(4-N-ethyl-N-chloroethylaminophenyl)ethylene-2-yl)-4,5,6,7-tetrachlorophthalide was used instead of 3,3-bis(1,1-bis(4-pyrrolidinophenyl)ethylene-2-yl)-4,5,6,7-tetrachlorophthalide to prepare a heat sensitive record material.

The heat sensitive record material was pressed with a pressure 4 kg/cm$^2$ for 5 seconds on a plate heated at 110° C. to develop black images. The difference in reflectance at 500–880 nm between the developed images and the record material was more than 71%.

EXAMPLE 10

Example 1 was repeated except that 2 parts of 3,3-bis(1,1-bis(4-N-metyl-N-2′,3′-dimethoxypropylamino-phenyl)-ethylene-2-yl)phthalide was used instead of 3,3-bis(1,1-bis(4-pyrrolidinophenyl)ethylene-2-yl)-4,5,6,7-tetrachlorophthalide to prepare a heat sensitive record material.

The heat sensitive record material was pressed with a pressure 4 kg/cm$^2$ for 5 seconds on a plate heated at 110° C. to develop black images. The difference in reflectance at 500–880 nm between the developed images and the record material before color-development was more than 74%.

EXAMPLE 11

Example 1 was repeated except that 3,3-bis(1,1-bis(2-methyl-4-pyrrolidinophenyl)ethylene-2-yl)-4,5,6,7-tetrachlorophthalide was used instead of 3,3-bis(1,1-bis(4-pyrrolidinophenyl)ethylene-2-yl)-4,5,6,7-tetrachlorophthalide to prepare a heat sensitive record material.

The heat sensitive record material was pressed with a pressure 4 kg/cm$^2$ for 5 seconds on a plate heated at 110° C. to develop black images. The difference in reflectance at 500–880 nm between the developed images and the record material before color-development was more than 75%.

EXAMPLES 12–18 and Controls 1–2.

Nine heat sensitive record materials were prepared in the same manner as in Example 1 except that 3,3-bis(1,1-bis(4-pyrrolidinophenyl)ethylene-2-yl)-4,5,6,7-tetrachlorophthalide was used in such an amount as shown in Table 1.

Each of the heat sensitive record materials was pressed with a pressure of 4 kg/cm$^2$ for 5 seconds on a plate heated at 110° C. to develop color images. The differences in reflectance at 580–880 nm between the images and the record materials before color-development are shown in Table 1.

TABLE 1

| | 3,3-bis(1,1-bis(4-pyrrolidinophenyl)-ethylene-2-yl)-4,5,6,7-tetrachloro-phthalide (parts) | difference in reflectance (%) |
|---|---|---|
| Example 12 | 2 | ≧73 |
| Example 13 | 3 | ≧72 |
| Example 14 | 4 | ≧70 |
| Example 15 | 5 | ≧67 |
| Example 16 | 6 | ≧63 |
| Example 17 | 7 | ≧60 |
| Example 18 | 8 | ≧58 |
| Control 1 | 10 | ≧54 |
| Control 2 | 12 | ≧51 |

EXAMPLE 19

2 parts of 3,3-bis(4-dimethylaminophenyl)-6-dimethylaminophthalide and 0.8 parts of 3,3-bis(1,1-bis(4-pyrrolidinophenyl)ethylene-2-yl)-phthalide were dissolved in 100 parts of isopropylated naphthalene. The resultant solution was dispersed in 350 parts of warm water (50° C.) containing 25 parts of pigskin-gelatin having an isoelectric point of 8 and 25 parts of gum arabic dissolved in it to obtain an emulsion. 1000 parts of warm water was added to the emulsion. The mixture was adjusted to pH 4 with acetic acid and cooled to 10° C. 10 parts of 25% aqueous solution of glutaraldehyde was added to it to solidify capsules. The capsule-containing coating composition was on one surface of a base sheet of 45 g/m$^2$ in the weight of 5 g/m$^2$ on dry basis and an acceptor coating composition comprising 20 parts of zinc 3,5-bis(α-methylbenzyl)salicylate, 80 parts of kaolin and 30 parts of styrene-butadiene copolymer emulsion (solid content: 50%) dispersed in 200 parts of water was coated on another surface of the base sheet in the weight of 5 g/m$^2$ on dry basis to obtain a pressure sensitive record material (middle sheet).

Several of the pressure sensitive record material were piled in the manner as the capsule coated layer was closed to the acceptor coated layer, pressed with driving a pen to obtain blue color images on the acceptor coated surface. The difference in reflectance at 580–880 nm between the images and the record material before color-development was more than 69%.

EXAMPLE 20

Example 19 was repeated except that 3′-phenyl-7-diethylamino-2,2′-spiro-di-(2H-1-benzopyran) was used instead of 3,3-bis(4-dimethylaminophenyl)-6-dimethylaminophthalide to prepare a pressure sensitive record material.

The difference in reflectance at 580–880 nm between the produced images and the record materials before color-development was more than 64%.

EXAMPLE 21

4 parts of 3-N-ethyl-N-i-pentylamino-6-methyl-7-anilinofluoran, 0.5 parts of 3,7-bis(dimethylamino)-10-benzoylphenothiazine and 0.8 parts of 3,3-bis(1,1-bis(4-N-ethyl-N-ethoxyethylaminophenyl)-ethylene-2-yl)-4,5,6,7-tetrachlorophthalide were dissolved in 100 parts of isopropylated naphthalene. The resultant solution was dispersed in 350 parts of warm water (50° C.) containing 25 parts of pigskin-gelatin having an isoelectric point of 8 and 25 parts of gum arabic dissolved in it to obtain an emulsion. 1000 parts of warm water was added to the emulsion. The mixture was adjusted to pH 4 with acetic acid and cooled to 10° C. 10 parts of 25% aqueous solution of glutaraldehyde was added to it to solidify capsules. The resultant capsule dispersion is referred to A liquid.

On the other hand, 40 parts of 10% aqueous solution of sodium hydroxide and 200 parts of activated clay were dispersed in 400 parts of water and then 200 parts of 10% aqueous solution of polyvinylalcohol was dispersed in it to obtain a dispersion. The dispersion was mixed with the above A liquid to prepare a coating composition.

The coating composition was coated on a base sheet of 45 g/m$^2$ in the weight of an amount of 7 g/m$^2$ on dry basis to obtain a pressure sensitive record material utilized in the "self contained" system. The pressure sensitive record material was pressed on the coating layer to develop black images at the pressed portions. The difference in reflectance at 500–880 nm between the images and the record material before color-development was more than 71%.

EXAMPLE 22

200 parts of cuprous iodide and 5 parts of 10% aqueous solution of sodium sulfite were added to 200 parts of 1% aqueous solution of polyvinyl alcohol. The mixture was passed through a sand mill. Pulverization was continued until an average particle size of 2 microns. To the pulverized mixture 8 parts of polyacrylate emulsion and 20 parts of titanium dioxide were added and thoroughly dispersed. The dispersion was coated on a base sheet of 50 g/m$^2$ in the weight of 7 g/m$^2$ on dry basis. Further, there was coated on the coating layer in the weight of 5 g/m$^2$ on dry basis a heat sensitive coating composition prepared by the same manner as in Example 1 except that 3-(N-ethyl-N-i-pentyl)amino-6-methyl-7-anilinofluoran was used instead of 3-(N-methyl-N-cyclohexyl-)amino-6-methyl-7-anilinofluoran to obtain an electrothermal record material.

Images were recorded on the record material with the use of a cylindrical scanning recording machine with a tungsten recording needle electrode at 150 V, a scanning speed of 630 mm/sec and a needle pressure of 10 g. The obtained images were dark blue. The difference in reflectance at 500–880 nm between the images and the record material before color-development was more than 76%.

What we claim is:

1. A record material which utilizes a color forming reaction between a substantially colorless chromogenic material and an electron accepting reactant material, comprising the improvements of a mixture of a first component being at least one phthalide compound having two vinyl linkages and a second component of another kind of chromogenic material, said first component being used in an amount of 5 to 80% by weight with respect to the amount of said second component and whereby the reflectance at any wavelength within the range of 580 nm to 880 nm of color images developed by said color forming reaction is at least 55% less than that of said record material before color developing, said phthalide compound being represented by the following formula,

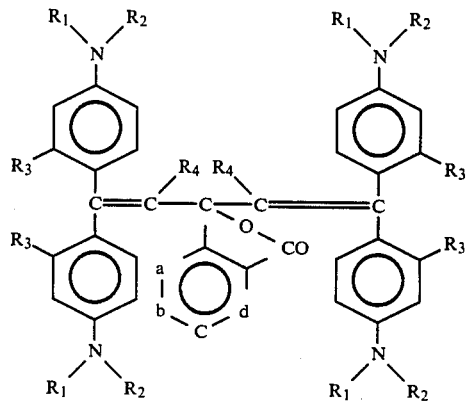

(I)

wherein each $R_1$, $R_2$ is alkyl which may be substituted by halogen, alkoxyl or acetyl, alicyclic, aryl which may be substituted by halogen, alkyl or alkoxyl, aralkyl which may be substituted by halogen, alkyl or alkoxyl, or one or both of $R_1$ and $R_2$ together with the adjacent nitrogen may form a heterocyclic ring; $R_3$ is hydrogen, halogen, alkyl, alkoxyl or acyloxy; $R_4$ is hydrogen or alkyl; and each of a, b, c, and d is carbon or nitrogen atom, but at least two of them are carbon atoms which may be substituted by hydrogen, halogen, alkyl, alkoxyl, dialkylamino or nitro, and an a—b, b—c, or c—d bond may form a part of another aromatic ring.

2. A record material as defined in claim 1, wherein the second component comprises at least one selected from the group consisting of fluoran compounds, triarylmethanelactone compounds and spiropyran compounds.

3. A record material as defined in claim 1, wherein the second component comprises at least one fluoran compound which can develop a black color upon contact with said electron accepting material and which has the following formula,

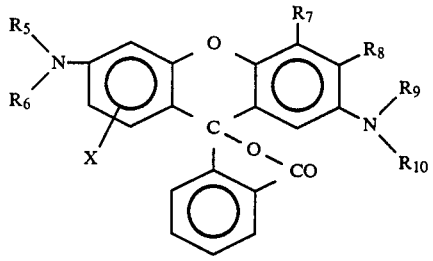

[II]

wherein each $R_5$, $R_6$ is alkyl which may be substituted by halogen or alkoxyl, unsaturated alkyl, alicyclic, aryl which may be substituted by halogen, alkyl or alkoxy, aralkyl which may be substituted by halogen, alkyl or alkoxyl, or both of $R_5$ and $R_6$ together with the adjacent nitrogen may form a heterocyclic ring; each $R_7$, $R_8$ is hydrogen, alkyl, halogen or alkoxy; each $R_9$, $R_{10}$ is hydrogen, alkyl which may be substituted by halogen, alkoxyl, alkoxycarbonyl or dialkylamino, alicyclic, aryl which may be substituted by halogen, alkyl, alkoxyl, halogenated alkyl, alkoxycarbonyl or dialkylamino, or aralkyl which may be substituted by halogen, alkyl, alkoxyl, halogenated alkyl, alkoxycarbonyl or dialkylamino; and X is hydrogen, alkyl or halogen.

4. A record material as defined in claim 1, wherein the second component comprises at least one triarylmethane compound which can develop a blue color upon contact with said electron accepting material and which has the following formula,

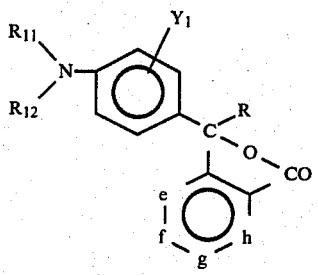

wherein each $R_{11}$ and $R_{12}$ is alkyl which may be substituted by halogen or alkoxyl, unsaturated alkyl, alicyclic, aryl which may be substituted by halogen, alkyl or alkoxy, aralkyl which may be substituted by halogen, alkyl or alkoxyl, or both of $R_{11}$ and $R_{12}$ together with the adjacent nitrogen may form a heterocyclic ring; $Y_1$ is hydrogen, alkyl, alkoxyl or halogen; R is

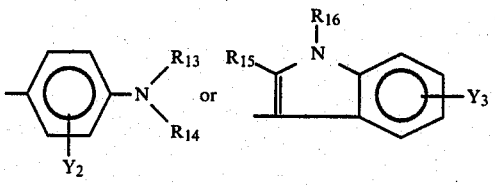

$R_{13}$ and $R_{14}$ are the same as described above for $R_{11}$ and $R_{12}$, each $Y_2$ and $Y_3$ is the same as described above as $Y_1$, $R_{15}$ is alkyl or phenyl, and $R_{16}$ is hydrogen or alkyl; each e, f, g, and h is a carbon or nitrogen atom but at least two are carbon atoms which may be substituted by hydrogen, alkyl, alkoxyl, halogen or

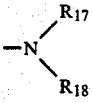

wherein $R_{17}$ and $R_{18}$ are the same as described above for $R_{11}$ and $R_{12}$ and an e—f, f—g or g—h may form a part of another aromatic ring.

5. A record material as defined in claim 1, wherein the second component comprises at least one spiropyran compound which can develop a blue color upon contact with said electron accepting material and which has the following formular,

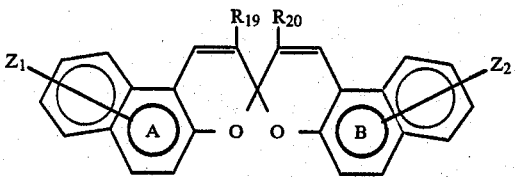

[IV]

wherein each $R_{19}$, $R_{20}$ is hydrogen, alkyl which may be substituted by halogen or alkoxyl, aralkyl which may be substituted by alkyl, halogen or alkoxyl, phenyl which may be substituted by alkyl, halogen or alkoxyl, or $R_{19}$ together with $R_{20}$ may form alkylene; each $Z_1$, $Z_2$ is hydrogen, halogen, alkyl, alkoxyl or

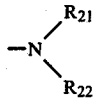

(each $R_{21}$, $R_{22}$ is alkyl which may be substituted by halogen or alkoxyl, unsaturated alkyl, alicyclic, aryl which may be substituted by halogen, alkyl or alkoxyl, aralkyl which may be substituted by halogen, alkyl or alkoxyl, or both of $R_{21}$ and $R_{22}$ together with the adjacent nitrogen may form a heterocyclic ring); and each A, B is benzene or naphthalene ring.

6. A record material as defined in claim 1, wherein the first component comprises at least one compound having the following formula,

[V]

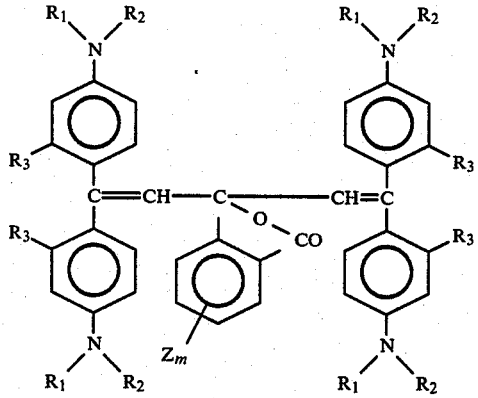

wherein $R_1$, $R_2$ and $R_3$ are the same as described above, Z is hydrogen or halogen, and m is an integer of 1 to 4, and the second component comprises at least one fluoran compound which can develop a black color upon contact with an electron accepting material and which has the following formula,

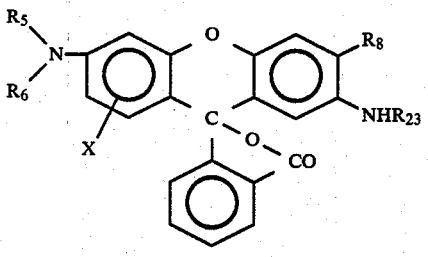

[VI]

wherein $R_5$, $R_6$, $R_8$ and X are the same as described above, and $R_{23}$ is the same as described above as $R_9$ and $R_{10}$.

7. A record material as defined in claim 6, wherein said second component is at least one fluoran compound which can develop a black color upon contact with said electron accepting material and which has the following formula,

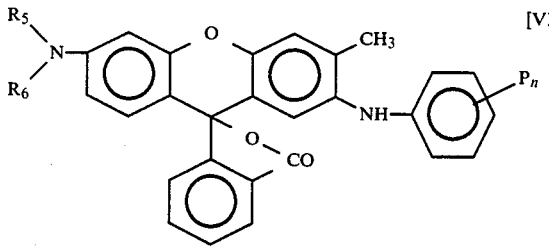

[VII]

wherein $R_5$ and $R_6$ are the same as described above, P is hydrogen, alkyl, alkoxyl, halogen, dialkylamino or halogenated alkyl, and n is an integer of 1 to 4.

8. A record material as defined in claim 6, wherein said second component is at least one fluoran compound which can develop a black color upon contact with said electron accepting material and which has the following formula,

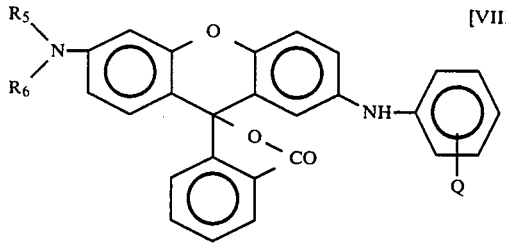

[VIII]

wherein $R_5$ and $R_6$ are the same as described above, and Q is halogen, halogenated alkyl or alkoxycarbonyl.

9. A record material as defined in claim 6, wherein said second component is at least one fluoran compound which can develop a black color and which has the following formula,

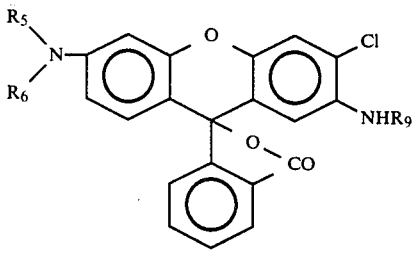

[IX]

wherein $R_5$, $R_6$ and $R_9$ are the same as described above.

10. A record material as defined in claim 1, wherein said record material is used in a heat sensitive recording system.

11. A record material as defined in claim 1, wherein said record material is used in a pressure sensitive recording system.

12. A record material as defined in claim 11, wherein said pressure sensitive recording system is of a self-contained type.

* * * * *